US005759118A

United States Patent [19]

Sroczynski

[11] Patent Number: 5,759,118

[45] Date of Patent: Jun. 2, 1998

[54] GOLF TEE WITH CROWN-SHAPED HEAD

[76] Inventor: Janet Sroczynski, 2016 Main Rd., Tiverton, R.I. 02878

[21] Appl. No.: 721,243

[22] Filed: Sep. 26, 1996

[51] Int. Cl.[6] ..... A63B 57/00

[52] U.S. Cl. ..... 473/387

[58] Field of Search ..... 473/387, 392, 473/403

[56] References Cited

U.S. PATENT DOCUMENTS

| | | | |
|---|---|---|---|
| D. 71,470 | 11/1926 | Lugar | 473/402 |
| D. 92,918 | 7/1934 | Millet . | |
| 1,335,005 | 3/1920 | Mahoney | 473/388 |
| 1,510,705 | 10/1924 | Folfe | 473/389 |
| 1,551,636 | 9/1925 | Bloom | 473/388 |
| 1,558,159 | 10/1925 | Futers et al. . | |
| 1,573,911 | 2/1926 | Budrow | 473/396 |
| 1,604,926 | 10/1926 | MacDonald | 473/390 |
| 1,638,527 | 8/1927 | Clausing . | |
| 1,643,113 | 9/1927 | Clark | 473/400 |
| 1,644,979 | 10/1927 | Clausing . | |
| 1,645,001 | 10/1927 | Hodges | 473/399 |
| 1,897,519 | 2/1933 | Kershaw | 473/389 |
| 2,930,615 | 3/1960 | Cowan | 473/388 |
| 3,782,723 | 1/1974 | Morris . | |
| 3,907,289 | 9/1975 | Bondu, Sr. . | |
| 3,947,027 | 3/1976 | Brown . | |
| 4,951,945 | 8/1990 | Gamble . | |
| 5,149,088 | 9/1992 | O'Hara . | |
| 5,193,803 | 3/1993 | Flick III . | |
| 5,195,743 | 3/1993 | Walsh, Jr. . | |

FOREIGN PATENT DOCUMENTS

| | | |
|---|---|---|
| 1 533 254 | 11/1978 | United Kingdom . |
| 2 209 952 | 6/1989 | United Kingdom . |

*Primary Examiner*—Theatrice Brown

*Attorney, Agent, or Firm*—Cesari and McKenna, LLP

[57] ABSTRACT

A golf tee includes an elongated shaft and an enlarged head. The head is crown-shaped, with six sides that form six points where adjoining sides meet. The sides, which extend outwardly from a center section on which the ball sits, are downwardly bowed to follow the contour of a golf ball. The sides thus engage the golf ball along their lengths, with the points extending slightly along the upward curvature of the ball. The points prevent the ball from inadvertently rolling off of the tee, but do not adversely affect the flight of a properly hit ball, since they do not extend sufficiently far along the upward curvature.

7 Claims, 1 Drawing Sheet

GOLF TEE WITH CROWN-SHAPED HEAD

FIELD OF THE INVENTION

The invention relates to golf tees, and in particular, to golf tees with shaped heads.

BACKGROUND

Golf is a game that is played by men, women and children of all sizes, shapes and abilities. Each golfer uses golf clubs that are preferably at least sized to a golfer's height, and may also be designed to a golfer's ability. Each golfer, regardless of size and/or ability, also uses golf tees, to elevate and position his or her golf balls appropriately for tee shots. The golf tees are generally of a conventional design.

The conventional golf tee is 2.1 inches long, and consists of a 1.75 inch long shaft with a circular cross-section, which is pointed on one end and has attached to the opposite end a head with a somewhat larger circular cross-section. The shaft has a diameter of 0.2 inches, and the head has a diameter of 0.5 inches. The head includes at its center a slight, circular depression that provides a seat for the golf ball. To prepare for a tee shot, the golfer pushes the pointed end of the shaft into the ground, such that the head of the tee, which is positioned above the ground, supports the golf ball.

The circular depression in the head positions the ball on the tee. The depression is purposefully sufficiently shallow (0.1 inches at center) to avoid adversely affecting the flight of a properly hit ball. At the same time, the depression inhibits somewhat but does not prevent the ball from rolling off of the tee, if the ball is inadvertently started moving by, for example, the wind.

To avoid having to bend down several times to set-up a tee shot, the golfer typically positions the tee in the ground by placing the ball on the head of the tee, gripping both the ball and the underside of the circular head between two fingers of his or her right hand (or left hand if the golfer is left-handed), placing the tee and ball slightly above the ground in the desired location and pushing the pointed end of the shaft into the ground by pushing down on the golf ball. If the golfer has large hands, however, he or she may not be able to easily grip the tee and position it in this manner—either because there is not enough of the shaft sticking out between the two fingers to push into the ground, or because the head is so small that it cannot be adequately gripped to hold the tee in place against the ball.

The length of the conventional tee shaft presents a beginner golfer with another problem, namely, it limits the height at which the ball can be positioned. The beginner may make a better tee shot if the ball is positioned far enough above ground to reduce the chance that the golfer hits the ground before he or she hits the ball.

SUMMARY OF THE INVENTION

The invention is a golf tee that includes a long shaft and an enlarged, "crown-shaped" head. The head consists of a center piece on which the ball rests and six shaped sides that extend upwardly and outwardly therefrom, to form a seat for the ball. The sides of the head are contoured to engage the ball and shaped to end essentially in points that prevent the ball from easily rolling off of the tee. The points are, however, low enough on the curvature of the ball that they do not interfere with the flight of the ball when the ball is hit.

The larger, crown-shaped head provides a better grip to a golfer who is trying to position the tee in the ground. Further, the longer shaft allows the golfer more selection in elevating the ball to a desired height.

BRIEF DESCRIPTION OF THE DRAWINGS

For a fuller understanding of the nature of the invention, reference should be had to the following detailed description taken in connection with the accompanying drawings, in which.

DETAILED DESCRIPTION

Figure 1:
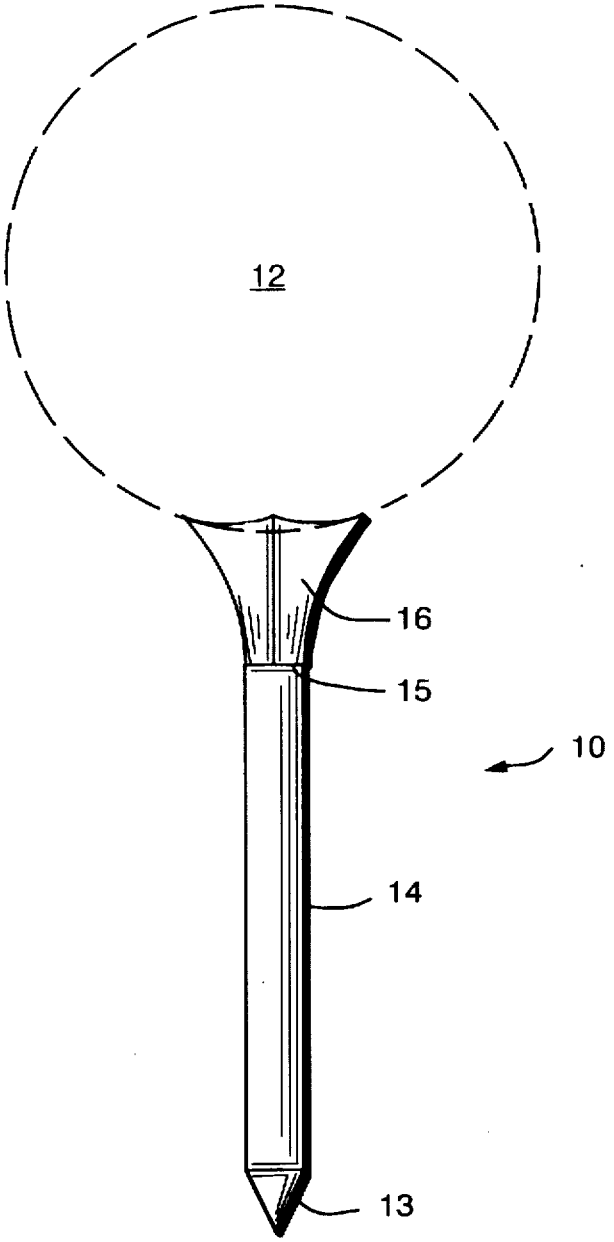
FIG. 1 is a side view of a golf tee constructed in accordance with the invention.
Figure 2:
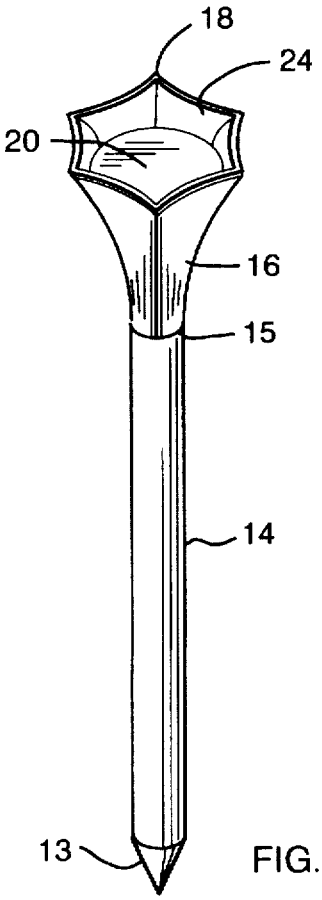
FIG. 2 is a perspective view of the golf tee of FIG. 1.

Referring to FIGS. 1 and 2, a golf tee 10 includes a relatively long shaft 14 that has a pointed end 13 and extends at its other end 15 to a crown-shaped head 16. The tee 10 supports a golf ball 12 that sits on a circular center section 20 of the head 16, and is retained in position by shaped sides 24, that follow the contour of the ball and engage it along their lengths. The sides 24, which are downwardly bowed, form points 18 where two sides 24 meet. The head 16 preferably has six sides 24 and six points 18. The points 18 do not interfere with the flight of a properly hit ball, since they extend only slightly along the upward curvature of the ball 12.

The shaft 14 is longer than the shaft of a conventional tee. In the preferred embodiment, the shaft is two inches long, which is 0.25 inches longer than the conventional tee shaft. The longer shaft 14 allows a golfer to position the ball further above the ground than he or she can with a conventional golf tee. This is particularly beneficial to beginners, who may want to elevate the ball to promote a cleaner tee shot. The longer shaft is also advantageous to the experienced golfer, since it allows the experienced golfer an option: to have an increased vertical plane length upon which to place the ball—allowing for a "higher-mounted" tee shot, or a "lower-mounted" tee shot, which is an improvement over the conventional golf tee.

The head 16 is larger than the conventional tee head, which has a diameter of 0.5 inches. In the preferred embodiment, the head 16 measures 0.6 inches across, from point to opposite point, and thus provides a larger seat for the golf ball. Further, the seat is 0.15 inches deep at center. Accordingly, the ball rests more fully on the head 16 than it does on the head of a conventional tee.

Figure 3:
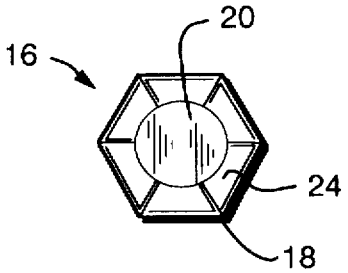
FIG. 3 is a top view of the golf tee of FIG. 1.

Referring also to FIG. 3, the sides 24 of the head 16 are contoured to the shape of a golf ball, with downwardly bowed sides that engage the ball and points 18 that extend along the upward curvature of the ball 12. The shaped sides 24 provide not only a larger seat for the ball, but also a larger head area for a golfer to grip between his or her fingers, when he or she is setting-up the tee and ball for a tee shot. This coupled with the longer shaft means that the tee 10 is easier to position for a tee shot, particularly if the golfer sets the tee and the ball up together.

The points 18 prevent a ball from easily rolling off of the tee, since to roll off the tee the ball must essentially roll up and over at least two of the points 18. This is in contrast to the conventional golf tee that seats the ball in the slight circular depression, which has a rounded rim. Essentially any movement of the ball tends to move the ball over the rounded rim, and thus, causes the ball to roll off of the tee.

The foregoing description has been limited to a specific embodiment of this invention. It will be apparent, however, that variations and modifications may be made to the invention, with the attainment of some or all of its advantages. Therefore, it is the object of the appended claims to cover all such variations and modifications as come within the true spirit and scope of the invention.

I claim:

1. A golf tee including:

A. a shaft for positioning the tee in the ground; and

B. a head for supporting a golf ball, the head including a plurality of inwardly and downwardly bowed sides joined along side edges to define upwardly directed points, the points engaging the golf ball when the ball rests on the tee.

2. The golf tee of claim 1 wherein the downwardly bowed sides include an upper edge shaped to follow the contours of the golf ball, and the points follow the upward curvature of the ball.

3. The golf tee of claim 2 wherein the head includes six downwardly bowed sides that join to form six points.

4. The golf tee of claim 3 wherein the head measures 0.6 inches across, from point to opposite point.

5. The golf tee of claim 1 wherein the head further includes a center section on which the golf ball engage.

6. The golf tee of claim 5 wherein the shaft is two inches in length.

7. A golf tee including:

A. a shaft for positioning the tee in the ground; and

B. a head, the head including i. a center for supporting a golf ball, and ii. a plurality of outwardly and upwardly sides extending from the center, the sides being joined along edges thereof and forming a plurality of upwardly directed points for engaging a golf ball where adjacent sides meet.

* * * * *